United States Patent [19]

Verzilli

[11] Patent Number: 4,771,514

[45] Date of Patent: Sep. 20, 1988

[54] ARRANGEMENT FOR CLEANING THE FLATS IN A REVOLVING FLATS CARD

[75] Inventor: Giuseppe Verzilli, Wiesendangen, Switzerland

[73] Assignee: Maschinenfabrik Rieter AG, Winterthur, Switzerland

[21] Appl. No.: 55,062

[22] Filed: May 28, 1987

[30] Foreign Application Priority Data

Jun. 5, 1986 [CH] Switzerland ..... 02289/86

[51] Int. Cl.[4] ..... D01G 15/76

[52] U.S. Cl. ..... 19/109; 19/111

[58] Field of Search ..... 19/109, 111

[56] References Cited

U.S. PATENT DOCUMENTS

| | | | |
|---|---|---|---|
| 1,363,094 | 12/1920 | Draper | 19/111 |
| 2,682,086 | 6/1954 | Barnet | 19/109 |
| 2,740,994 | 4/1956 | Rowe | 19/109 |
| 2,935,766 | 5/1960 | Lehmann | 19/106 |
| 3,321,810 | 5/1967 | Burnham | 19/111 X |
| 3,529,326 | 9/1970 | Nutter et al. | 19/109 |
| 4,126,915 | 11/1978 | Zieg et al. | 19/111 |

FOREIGN PATENT DOCUMENTS

| | | |
|---|---|---|
| 1955775 | 5/1971 | Fed. Rep. of Germany . |
| 0517929 | 5/1921 | France . |
| 0452407 | 5/1968 | Switzerland . |
| 0791472 | 3/1958 | United Kingdom . |

*Primary Examiner*—Louis K. Rimrodt

*Attorney, Agent, or Firm*—Werner W. Kleeman

[57] ABSTRACT

A cleaning apparatus or arrangement for cleaning a set of flats of a revolving flats card has a pivotable brush for engaging the strips or strip accumulations of the flats and a suction device arranged behind or downstream of the pivotable brush considered with respect to the direction of movement of the flats. According to the invention, a suction nozzle of the suction device is reciprocable over the length or transverse extent of the flats. By means of this arrangement, there is obtained a suction action affording a great cleaning or stripping effect at the flats despite a considerable reduction in the energy required to create the suction action in comparison with heretofore known flat cleaning or stripper arrangements.

13 Claims, 3 Drawing Sheets

ARRANGEMENT FOR CLEANING THE FLATS IN A REVOLVING FLATS CARD

BACKGROUND OF THE INVENTION

The present invention broadly relates to a new and improved apparatus or arrangement for cleaning or stripping the flats in a revolving flats card.

Generally speaking, the cleaning or stripping apparatus or arrangement for cleaning or stripping the set of flats or flats in a revolving flats card, particularly for instance a card serving for processing of short staple fiber material, for example cotton, is of the type comprising a pivotable brush or brush member extending over the complete length of each of the flats for stripwise engaging or catching of the waste material or trash located at the flats. There is also provided a suction device serving for carrying away the waste material, typically the flat strips or strip accumulations. The suction device is located behind or downstream of the brush considered with respect to the direction of movement of the flats or set of flats.

Swiss Patent No. 501,069 discloses an arrangement for cleaning card flats in which the wires of a cleaning comb take-up fibers and impurities during their pivotal movement in the forward direction. During the pivotal movement of the wires of the cleaning comb in the reverse direction, the fibers and impurities come to lie on the points or tips of the clothing of the flats. These fibers and impurities are sucked-in by a suction trumpet pivoting together with the cleaning comb, either on the return stroke or during the next forward stroke.

The suction trumpet, which extends over the whole length of the flats, requires a very high suction power for the faultless removal of the flat strips or flat strip accumulations. Accordingly, this arrangement has proven to be uneconomical.

SUMMARY OF THE INVENTION

Therefore, with the foregoing in mind, it is a primary object of the present invention to provide a new and improved cleaning apparatus or arrangement for cleaning or stripping the flats in a revolving flats card such that there are avoided or at least appreciably mitigated the aforementioned drawbacks and shortcomings of the prior art constructions.

Still another noteworthy object of the present invention is directed to an improved construction of cleaning or stripping apparatus for cleaning or stripping the flats in a revolving flats card such that the cleaning or stripping action can be effectively controlled at the flats so as to ensure for positive removal of the waste material in a highly reliable fashion.

Yet a further significant object of the present invention aims at providing a new and improved cleaning apparatus or arrangement for cleaning or stripping the flats in a revolving flats card which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the cleaning apparatus or arrangement for cleaning or stripping the flats in a revolving flats card is manifested by the features that the suction device comprises a suction nozzle which is reciprocable over the length or transverse extent of the set of flats or flats along a guide means, such as a rail or rail member extending transverse to the direction of movement of the flats.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
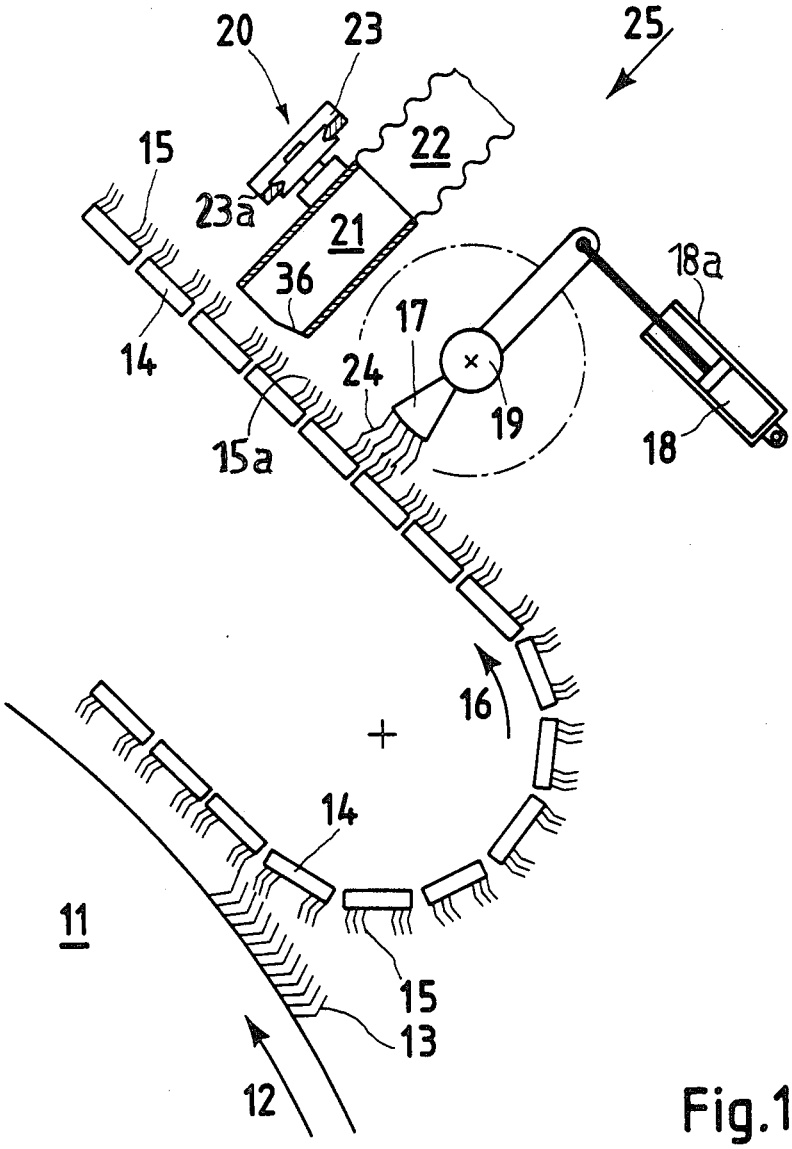
FIG. 1 shows a schematic representation of the cleaning apparatus or arrangement for cleaning or stripping the flats in a revolving flats card viewed from the side and constructed in accordance with the present invention.

Describing now the drawings, it is to be understood that to simplify the showing thereof, only enough of the cleaning apparatus or arrangement for cleaning or stripping the flats of waste material, namely strip accumulations or the like in a revolving flats card and the related card or carding machine has been illustrated therein as needed to enable one skilled in the art to readily understand the underlying principles and concepts of this invention. Turning now specifically to FIG. 1 of the drawings, the cleaning apparatus or arrangement illustrated therein by way of example and not limitation will be seen to comprise a main or card cylinder 11 of a card or carding machine and which is rotatable in the direction of the arrow 12 and is conventionally fitted with clothing 13. The flats 14, each of which is also provided with clothing 15, collectively constitute a set or chain of flats. These flats or set of flats 14 are movable in the direction of the arrow 16.

A brush or brush member 17 or equivalent structure, which extends over the complete length or transverse extent of each of the flats 14 moving therepast and which has approximately the same length as each flat 14, is pivotable about a shaft or pivot axis 19 by means of a suitable drive or drive means 18, here shown as constituted, for instance, by a fluid-operated piston-and cylinder unit 18*a*. A suction device 20 is located behind or downstream of the brush or brush member 17 considered with respect to the direction of movement of the flats 14 which, as previously mentioned, has been indicated by the arrow 16.

The suction device 20 comprises a suction nozzle 21 of elongated form and a hose or tube 22 or equivalent structure which is operatively connected with the suction nozzle 21 in order to lead away the suction air. In addition, the suction device 20 comprises a suitable guide member or guide means 23*a* for guiding the suction device 20 transversely of the direction of movement 16 of the set of flats or flats 14, and in the exemplary embodiment under consideration such guide member or guide means 23*a* is constituted, for instance, by a rail or rail member 23. The suction nozzle 21 is supported by and movable or reciprocable to-and-fro, by the action of a suitable drive, along this rail or rail member 23 in a direction extending transverse to the direction of movement 16 of the flats 14, that is, at essentially right angles to the plane of the drawing of FIG. 1.

During operation of the card or carding machine and as is well known in this technology, the main cylinder 12 rotates at a relatively high velocity or speed in the direction indicated by the aforementioned arrow 12. On the other hand, the flats 14 move only relatively slowly, for example, at about 10 cm/min. in the direction of the aforementioned arrow 16. Consequently, by virtue of the cooperation of the clothing 13 of the main cylinder 12 and the clothing 15 of the flats 14 there is effectuated a carding action or effect upon the textile fibers, such as, for instance, short staple fibers or other fiber material which is being processed and carried in by the main cylinder clothing 13. During the course of this carding operation, short fibers, foreign matter, naps and the like are entrained or taken-up by the clothing 15 of the flats 14. Accordingly, in the suction region, in particular at the region of the suction nozzle 21 the clothing 15 of the flats 14 is filled with such material, generally referred to hereinafter as waste material or trash.

The brush or brush member 17 is caused to perform pivotal or rocking movements by means of the drive or drive means 18 in order to clean the clothing 15 of the flats 14 before they return to the operating region of the card. The wires or bristles 24 or equivalent structure of the brush or brush member 17 lift the waste material to be removed out of the clothing 15 and leave it in the form of flat strips or flat strip accumulations on the points or tips 15*a* of the clothing 15 of the flats 14. The flat strips or flat strip accumulations are then carried along with the set of flats or flats 14 in the direction of the arrow 16. The waste material is now effectively sucked-away by the suction action exerted by the suction nozzle 21 when such waste material travels into the region over which the suction nozzle 21 passes or travels. It is therefore clear that, for complete removal of the flat strips or flat strip accumulations, each portion of the surface of the set of flats or flats 14 must be subjected to the suction action or suction cleaning effect at least once.

Figure 2:
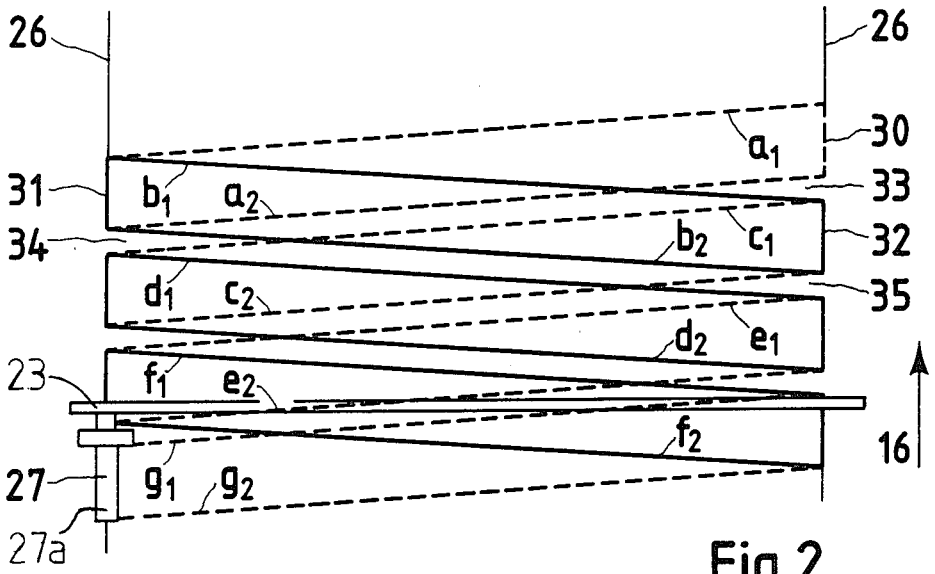
FIGS. 2, 3 and 4 are respective diagrams serving for explanation of the mode of operation of the flat cleaning or stripping apparatus according to the present invention.
Figure 3:
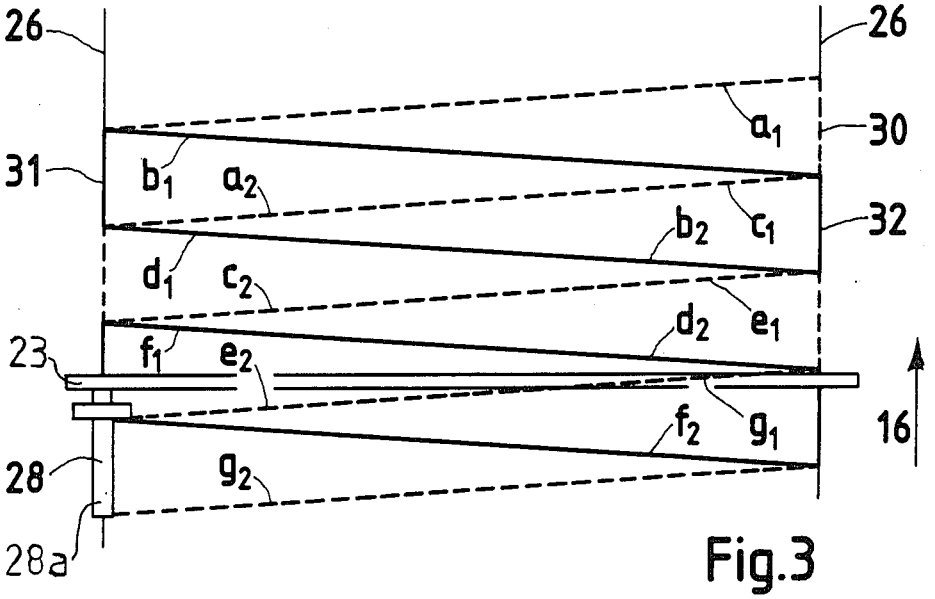
Figure 4:
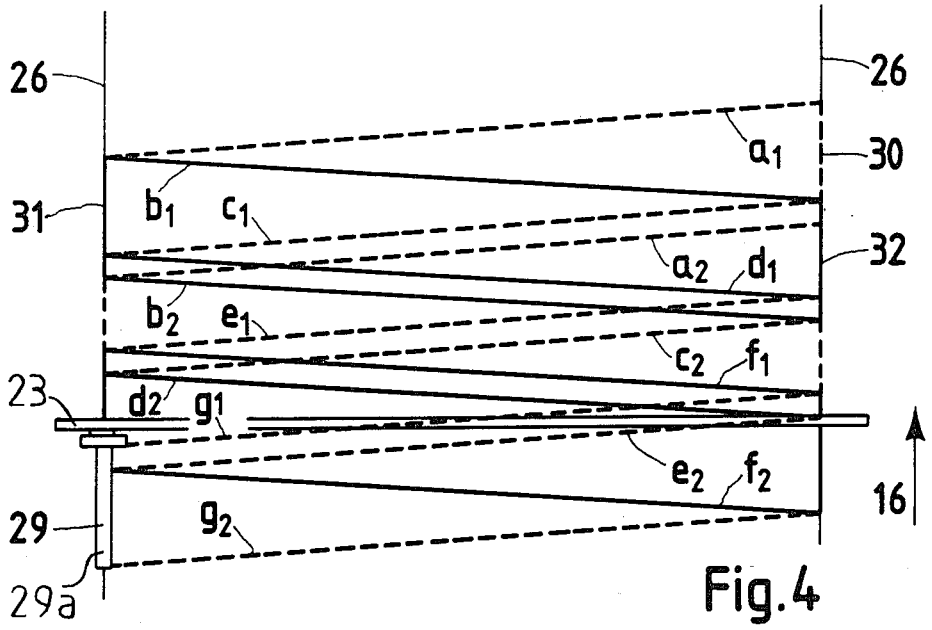

Reference will now be made to FIGS. 2, 3 and 4 for a more detailed description of the operation of the cleaning apparatus or arrangement heretofore described. These FIGS. 2, 3 and 4 each show a view of the surface of the set of flats or flats 14 as seen when looking in the direction of the arrow 25 in FIG. 1. However, as a matter of convenience in illustration and for purposes of enhancing comprehension of the operation of the different designs of the inventive flat cleaning or stripping apparatus depicted in FIGS. 2, 3 and 4, the individual flats 14 are not shown but only the lateral limits or the sides 26 of the set of flats or flats 14.

The direction of movement of the set of flats or flats 14 is again conveniently indicated by the arrow 16. The velocity or speed of movement of the flats 14 is assumed to be the same in each of the FIGS. 2, 3 and 4.

Furthermore, FIGS. 2, 3 and 4 each show the guide means for the related suction nozzle, here the rail or rail member 23 illustrated purely schematically. The three illustrated constructions of suction nozzles 27, 28 and 29 for the three respective different arrangements shown in FIGS. 2, 3 and 4, and with each such suction nozzle 27, 28 and 29 carried by its associated rail or rail member 23, each have a respective suction nozzle opening, generally indicated by reference characters 27*a*, 28*a* and 29*a*, respectively, of substantially quadrilateral section or cross-sectional configuration and the individual suction nozzles 27, 28 and 29 are of various lengths. The suction nozzle 27 is the shortest and the suction nozzle 29 the longest, as will be evident from FIGS. 2, 3 and 4. The speed with which the suction nozzles 27, 28 and 29 move at essentially right angles to the length of the set of flats or flats 14, i.e. to the sides 26 depicted in FIGS. 2 to 4, is the same in all three FIGS. 2, 3 and 4. It will be apparent from these FIGS. 2, 3 and 4 that the longitudinal direction of the quadrilateral nozzle openings 27*a*, 28*a* and 29*a* extends substantially parallel to the direction of movement of the set of flats or flats 14 indicated by the arrows 16.

FIGS. 2, 3 and 4 show the respective surfaces travelled over by the nozzle openings 27*a*, 28*a* and 29*a* of the suction nozzles 27, 28 and 29, respectively, during operation of the card. For purposes of explanation and illustration, it is assumed that at the start of the operation under consideration, the respective suction nozzle 27, 28 and 29 of FIGS. 2, 3 and 4 was located in the position 30. During the first stroke or movement of each suction nozzle 27, 28 and 29 from its position 30 over the length or transverse extent of the set of flats or flats 14, the latter carries out a forward movement so that at the end of its stroke, the corresponding suction nozzle is located in effect in the position 31. In the course of this stroke, in each of FIGS. 2, 3 and 4, the corresponding suction nozzle travels over the surface defined between the lines a1 and a2. After the next stroke, that is, after the completion of one traverse cycle or double stroke of the corresponding suction nozzle (forward and reverse movement thereof), the suction nozzles 27, 28 and 29 are located in the positions 32 and have additionally travelled over and acted upon the surface lying between the lines $b_1$ and $b_2$. After completion of the traverse cycle or double stroke, the forward movement of the set of flats or flats 14, is thus the same, for example the length taken along the right hand side 26 of the set of flats or flats 14 in each of FIGS. 2, 3 and 4 and lying between the lines $a_1$ and $b_1$.

During subsequent movements, the suction nozzles 27, 28 and 29 travel over the surfaces defined between the lines $c_1$ and $c_2$, the lines $d_1$ and $d_2$, the lines $e_1$ and $e_2$, the lines $f_1$ and $f_2$ and the lines $g_1$ and $g_2$. Fina11y, therefore, the suction nozzles 27, 28, 29 arrive in the illustrated positions. The lines a, c, e and g have been drawn as dotted lines and the lines b, d, f have been drawn in full or solid lines. This has been done only for the purpose of improving the clarity of the representation.

It will be apparent from the arrangement depicted in FIG. 2, that the suction nozzle 27 does not travel over triangular surfaces generated on the envelope or surface of the set of flats or flats 14. The uppermost such triangular surface or triangle 33 is defined between the right-hand side 26 in FIG. 2 and the lines a2 and b1. The next lower triangular surface or triangle 34 is defined by the left-hand side 26 in FIG. 2 and the lines b2 and c1, the next lowest triangular surface or triangle 35 by the right-hand side 26 and the lines c2 and d1, and so forth.

In the arrangement of FIG. 3, the length of the suction nozzle opening 28*a* of the suction nozzle 28 is equal to the length of the forward movement of the set of flats or flats 14 during a traverse cycle or double stroke of the suction nozzle 28. It is therefore apparent from the showing of FIG. 3, that under these conditions, there are no triangular surfaces which remain untreated or not acted upon by the suction nozzle 28.

If the suction nozzle 29 i.e. the suction nozzle opening 29*a* thereof, as illustrated in the arrangement of FIG. 4, is made longer than the length of the forward movement of the set of flats or flats 14 during a traverse cycle or double stroke of the suction nozzle 29, then untreated surfaces are certainly avoided.

Thus, it is apparent that treatment of every part of the surface or envelope of the set of flats or flats to be cleaned is realized on the condition that the length of the nozzle opening of the related suction nozzle is at least equal to or is longer than the forward movement of the set of flats during a traverse cycle or double stroke of the corresponding suction nozzle. It should be borne in mind that, strictly speaking, it is not the size of the nozzle opening which represents the decisive dimension but the "region of the suction effect or action of the suction nozzle". This is to be taken into account in particular in relation to the aforedescribed arrangements where the length of the suction opening of the suction nozzle in a direction parallel to the movement of the flats is the same as or greater than the forward movement of the set of flats or flats during a traverse cycle or double stroke of the suction nozzle.

If the cleaning apparatus or arrangement is to be so designed that the suction nozzle travels more than once over each portion of the surface or envelope of the set of flats or flats, then this can be achieved by providing a suction nozzle opening which is relatively long in the direction of the arrow 16 representing the direction of movement of the set of flats or flats and by mutual adaptation of the forward movement of such flats or set of flats and the number of traverse cycles or double strokes of the related suction nozzle. For a given forward movement of the flats or set of flats, the speed of movement of the suction nozzle, the energy consumption of the suction nozzle and the danger of blockage thereof must be weighed against each other. It is advantageous, provided this can be realized under the given circumstances, to ensure that each part of the flats or set of flats is treated more than once by the related suction nozzle; up to 5 such suction nozzle treatments or nozzle stripping or cleaning actions can be provided.

A very good mode of operation was achieved through the use of a cleaning apparatus or arrangement as described herein with a flat speed of approximately 10 cm/min. and 5 to 10 traverse cycles or double strokes of the associated suction nozzle per minute.

As already mentioned, the suction nozzle opening is advantageously designed to possess a quadrilateral or quadrangular form or cross-sectional configuration. However, a different form, such as an elliptical form or cross-sectional shape can also be taken into consideration. The longitudinal dimension of the suction nozzle opening is disposed substantially parallel to the direction of movement of the set of flats or flats 14 indicated by the arrow 16. An advantageous embodiment of a quadrilateral nozzle opening is one possessing a rectangular shape such that the relationship between the length of the suction nozzle opening and its width or breadth assumes a value lying between 3 and 7. In an embodiment which provided very good results, the rectangular suction nozzle opening was 12 cm long and 2.5 cm wide.

With reference to the possibility of blockage of the suction nozzle, it has been found that this risk can be substantially reduced if the suction nozzle is provided with an inclination or bevelled or inclined portion in its front region or portion considered with reference to the direction of movement 16 of the set of flats or flats 14; this inclination or inclined portion should extend upwardly at an angle towards the front edge of the suction nozzle, that is to say, away from the set of flats or flats 14. This inclination or inclined portion is indicated by reference numeral 36 in FIG. 1. A good mode of operation was obtained with a spacing of approximately 3 millimeters between the suction nozzle opening and the points or tips 15*a* of the clothing 15 of the flats 14.

While there are shown and described present preferred embodiments of the invention, it is to be distinctly understood that the invention is not limited thereto, but may be otherwise variously embodied and practiced within the scope of the following claims:

Accordingly, what I claim is:

1. A cleaning apparatus for cleaning flats moving in a predetermined direction of movement in a revolving flats card for processing fiber material, comprising:

a movable brush extending over substantially the complete length of each of the flats moving in relation to said movable brush and past said movable brush for engaging waste material carried at the flats;

a suction cleaning apparatus for stripping the waste material from the flats and for removal of such stripped waste material;

said suction cleaning apparatus being located downstream of said brush considered with respect to the predetermined direction of movement of the flats;

said suction cleaning apparatus comprises:

a suction nozzle; and means for mounting said suction nozzle to be reciprocable over the length of the flats in a direction extending transverse to the predetermined direction of movement of the flats;

each of the flats has a lengthwise direction;

said suction nozzle has a predeterminate speed in said lengthwise direction of the flats;

said flats have a predetermined forward speed in said predetermined direction of movement of the flats; and said predeterminate speed of said suction nozzle and said predeterminate forward speed of said flats being coordinated with respect to one another such that each portion of said flats is treated by said suction nozzle from 1 to 5 times.

2. The cleaning apparatus as defined in claim 1, wherein:

said means for mounting said suction nozzle comprises guide means for mounting the suction nozzle for carrying out a reciprocal motion over the length of the flats in a direction extending transverse to the predetermined direction of movement of the flats.

3. The cleaning apparatus as defined in claim 2, wherein:

said guide means comprises a rail member extending transverse to the predetermined direction of movement of the flats.

4. The cleaning apparatus as defined in claim 1, further including:

means for mounting said movable brush so as to be pivotable in a direction extending substantially parallel to the predetermined direction of movement of the flats.

5. The cleaning apparatus as defined in claim 1, wherein:

said suction nozzle possesses a cross-sectional configuration of elongated form and having a length dimension; and said length dimension of said suction nozzle extending in the predetermined direction of movement of said flats.

6. The cleaning apparatus as defined in claim 5, wherein:

each of said flats has clothing having points;

said suction nozzle having a suction nozzle opening; and said suction nozzle opening having a spacing from the points of the clothing of the flats which amounts to approximately 3 mm.

7. The cleaning apparatus as defined in claim 5, wherein:

said suction nozzle has a substantially quadrilateral-shaped suction nozzle opening;

said substantially quadrilateral-shaped suction nozzle opening having a predeterminate length and a predeterminate width; and said predeterminate length and said predeterminate width of said substantially quadrilateral-shaped suction nozzle defining a quotient which assumes a value in a range of between about 3 and 7.

8. The cleaning apparatus as defined in claim 7, wherein:

said quotient assumes a value of approximately 5.

9. The cleaning apparatus as defined in claim 7, wherein:

said substantially quadrilateral-shaped suction nozzle opening is of substantially rectangular configuration.

10. The cleaning apparatus as defined in claim 1, wherein:

said suction nozzle has a suction nozzle opening including a forward portion; and said forward portion of said suction nozzle opening possessing an inclined portion extending upwardly at an angle, considered with respect to the predetermined direction of movement of said flats.

11. The cleaning apparatus as defined in claim 1 wherein:

said suction nozzle has a suction nozzle opening;

said suction nozzle opening having a predeterminate length;

the reciprocal motion of the suction nozzle back-and-forth one time over the length of each flat defining a traverse cycle; and said predeterminate length of the suction nozzle opening in a direction extending substantially parallel to the predetermined movement of said flats being substantially the same as the predeterminate forward movement of the flats during each traverse cycle of said suction nozzle.

12. The cleaning apparatus as defined in claim 1, wherein:

said suction nozzle has a suction nozzle opening;

said suction nozzle opening having a predeterminate length;

the reciprocal motion of the suction nozzle back-and-forth one time over the length of each flat defining a traverse cycle; and said predeterminate length of the suction nozzle opening in a direction extending substantially parallel to the predetermined movement of said flats being greater than the predeterminate forward movement of the flats during each traverse cycle of said suction nozzle.

13. A cleaning apparatus for cleaning flats moving in a predetermined direction of movement in a revolving flats card for processing fiber material, comprising:

a movable brush extending over substantially the complete length of each of the flats moving in relation to said movable brush and past said movable brush for engaging waste material carried at the flats;

a suction cleaning apparatus for stripping the waste material from the flats and for removal of such stripped waste material;

said suction cleaning apparatus being located downstream of said brush considered with respect to the predetermined direction of movement of the flats;

said suction cleaning apparatus comprises:

a suction nozzle; and means for mounting said suction nozzle to be reciprocable over the length of the flats in a direction extending transverse to the predetermined direction of movement of the flats;

said suction nozzle has a predeterminate speed in said lengthwise direction of the flats;

the reciprocal motion of the suction nozzle back-and-forth one time over the length of each flat defining a traverse cycle;

said flats have a predeterminate forward speed in said predetermined direction of movement of the flats amounting to approximately 10 cm/min; and said suction nozzle performing 5 to 10 such traverse cycles each minute during such time as said forward speed of said flats is approximately 10 cm/min.

* * * * *